US007070688B2

(12) United States Patent
Donovan, III

(10) Patent No.: US 7,070,688 B2
(45) Date of Patent: Jul. 4, 2006

(54) ELECTROPLATING TOOL AND METHOD FOR SELECTIVE PLATING

(75) Inventor: Lawrence P. Donovan, III, Lowell, MI (US)

(73) Assignee: Lacks Enterprises, Inc., Grand Rapids, MI (US)

( * ) Notice: Subject to any disclaimer, the term of this patent is extended or adjusted under 35 U.S.C. 154(b) by 227 days.

(21) Appl. No.: 10/778,409

(22) Filed: Feb. 16, 2004

(65) Prior Publication Data

US 2005/0178665 A1 Aug. 18, 2005

(51) Int. Cl.
*C25D 5/02* (2006.01)
*C25D 17/00* (2006.01)

(52) U.S. Cl. ..... 205/128; 204/224 R; 204/297.06; 205/134; 205/136

(58) Field of Classification Search ..... 205/118, 205/128, 134, 136; 204/224 R, 297.01, 297.06, 204/297.1, 297.12, 297.14
See application file for complete search history.

(56) References Cited

U.S. PATENT DOCUMENTS 4,152,241 A * 5/1979 Warren ..... 204/297.1
4,312,716 A * 1/1982 Maschler et al. ..... 205/128

* cited by examiner

*Primary Examiner*—Nam Nguyen
*Assistant Examiner*—Luan V. Van
(74) *Attorney, Agent, or Firm*—Price, Heneveld, Cooper, DeWitt & Litton, LLP

(57) ABSTRACT

A tool for electroplating a portion of the surface of each of a plurality of pieces includes a first plate having a plurality of holes, and a second plate having a plurality of retaining elements. Each of the holes is configured to receive a piece that is to be electroplated, and to mask a portion of the surface and expose another portion of the surface of the piece. The first and second plates are held together, and a mechanism is provided for shifting one of the plates with respect to the other between a first orientation in which the retaining elements are disengaged from pieces received in the holes and a second orientation in which the retaining elements are engaged with pieces received in the holes. This arrangement allows the pieces to be quickly and easily retained for an electroplating operation and released after the electroplating operation.

20 Claims, 6 Drawing Sheets

ELECTROPLATING TOOL AND METHOD FOR SELECTIVE PLATING

FIELD OF THE INVENTION

This invention relates to an electroplating tool, and more particularly to an electroplating tool for electroplating selected surfaces of a plurality of pieces simultaneous.

BACKGROUND OF THE INVENTION

It is sometimes desirable to electroplate selected surfaces of a small component or part (e.g., a valve component). This may be desirable in order to provide a functional and/or esthetic plating on the selected surfaces.

There are several problems associated with economically electroplating surfaces of a multiplicity of small parts simultaneously. A problem that must be considered during design of an electroplating tool for holding a large number of small parts during an electroplating process is how to provide good electrical contact with each of the parts without having to carefully align or attach electrical contacts individually to each of the parts. Another problem that must be considered is how to firmly hold each of the parts on the tool during the electroplating process. There is also some difficulty associated with achieving uniform plating thickness for a large number of parts held on a single electroplating tool. Specifically, there is a tendency for heavier plating to occur on surfaces exposed to higher current densities.

It would be desirable to provide an electroplating tool that is capable of quickly locking each of a large number of individual parts on the tool in a simple operation. It would also be desirable to provide a tool that is capable of establishing a good electrical connection with each of the parts in a simple operation. Features that allow modification of the local current density would also be desired to achieve more uniform plating thicknesses for each part and among all parts.

SUMMARY OF THE INVENTION

In accordance with an aspect of this invention, there is disclosed an improved electroplating tool for selectively plating a portion of the surface of each of a plurality of pieces. The electroplating tool includes a first plate having a face defining a plurality of holes arranged in a pattern, with each of the holes configured to receive a piece that is to be electroplated. Each hole is also configured to mask a portion of the surface of a piece received in the hole and expose another portion of the surface of the piece for electroplating. The electroplating tool further includes a second plate having a plurality of retaining elements. The second plate is held in a predetermined spatial relationship with respect to the first plate. A mechanism is provided for shifting one of the first and second plates with respect to the other of the first and second plates between a first orientation in which the retaining elements are in a position corresponding to disengagement with pieces received in the holes and a second orientation in which the retaining elements are in a second orientation corresponding to engagement with pieces received in the holes. An advantage of this arrangement is that it allows all of the pieces to be firmly held in the tool during an electroplating operation by simply shifting one of the plates with respect to the other into the second orientation so as to effect engagement of the retainers with the pieces, and to allow easy release of the pieces after the electroplating operation by shifting one of the plates with respect to the other to the first orientation whereby the retainers are disengaged from the pieces and can be easily removed from the tool.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
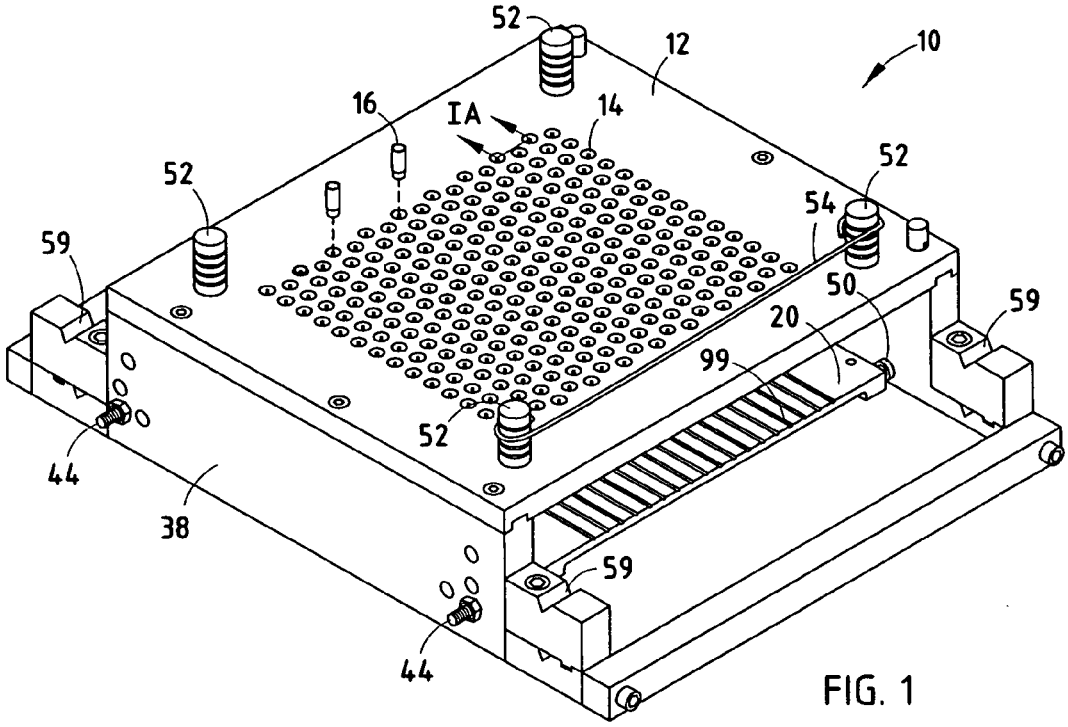
FIG. 1 is a perspective view of an electroplating tool in accordance with the invention.
Figure 1A:
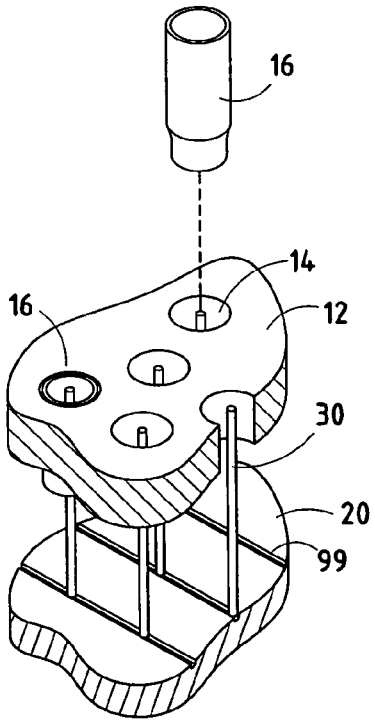
FIG. 1A is an enlarged cut away perspective view as seen along lines IA of FIG. 1, showing details of the electroplating tool of FIG. 1.
Figure 2:
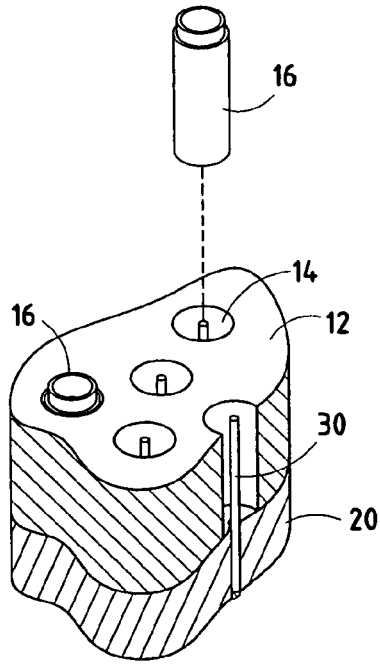
FIG. 2 is an enlarged cut away perspective view as seen along lines II—II of FIG. 3, showing details of the electroplating tool of FIG. 3.

An electroplating tool 10 (FIG. 1) in accordance with this invention includes a first plate 12 having a face 13 defining a plurality of holes 14 arranged in a pattern, with each of the holes 14 configured to receive a piece 16 that is to be electroplated. Each hole is generally shaped to conform with the piece received in the hole for electroplating. However, holes 14 are configured to allow at least a portion of the surface of the piece received in the hole to be exposed for electroplating, while the remaining portion is masked during the electroplating process. Electroplating tool 10 also includes a second plate 20 having a plurality of retaining elements 30 (FIG. 2). First plate 12 and second plate 20 are held together in a predetermined spatial relationship. In general, this relationship is either an abutting relationship (FIGS. 2–6) in which a major surface or face 13 of one of the plates is held to the major surface or face 23 of the other plate, or a spaced parallel relationship (FIGS. 1A, 7, 8 and 9) in which a major surface or face 13 of one of the plates is held in a spaced parallel relationship to a major surface or face 23 of the other plate. A mechanism is provided for shifting one of the first and second plates with respect to the other of the first and second plates between a first orientation in which the retaining elements are in a position corresponding to disengagement with pieces received in the holes and a second orientation in which the retaining elements are in a second orientation corresponding to engagement with pieces received in the holes.

In one embodiment (FIGS. 1–9), the retaining elements are prongs 30 that project from a face 23 of second plate 20. Prongs 30 are arranged on second plate 20 in a pattern that corresponds with the pattern of holes 14 in first plate 12. Each prong 30 is inserted into a corresponding hole 14 in the first plate 12 and through an opening 32 in piece 16 that is located in hole 14.

Figure 11:
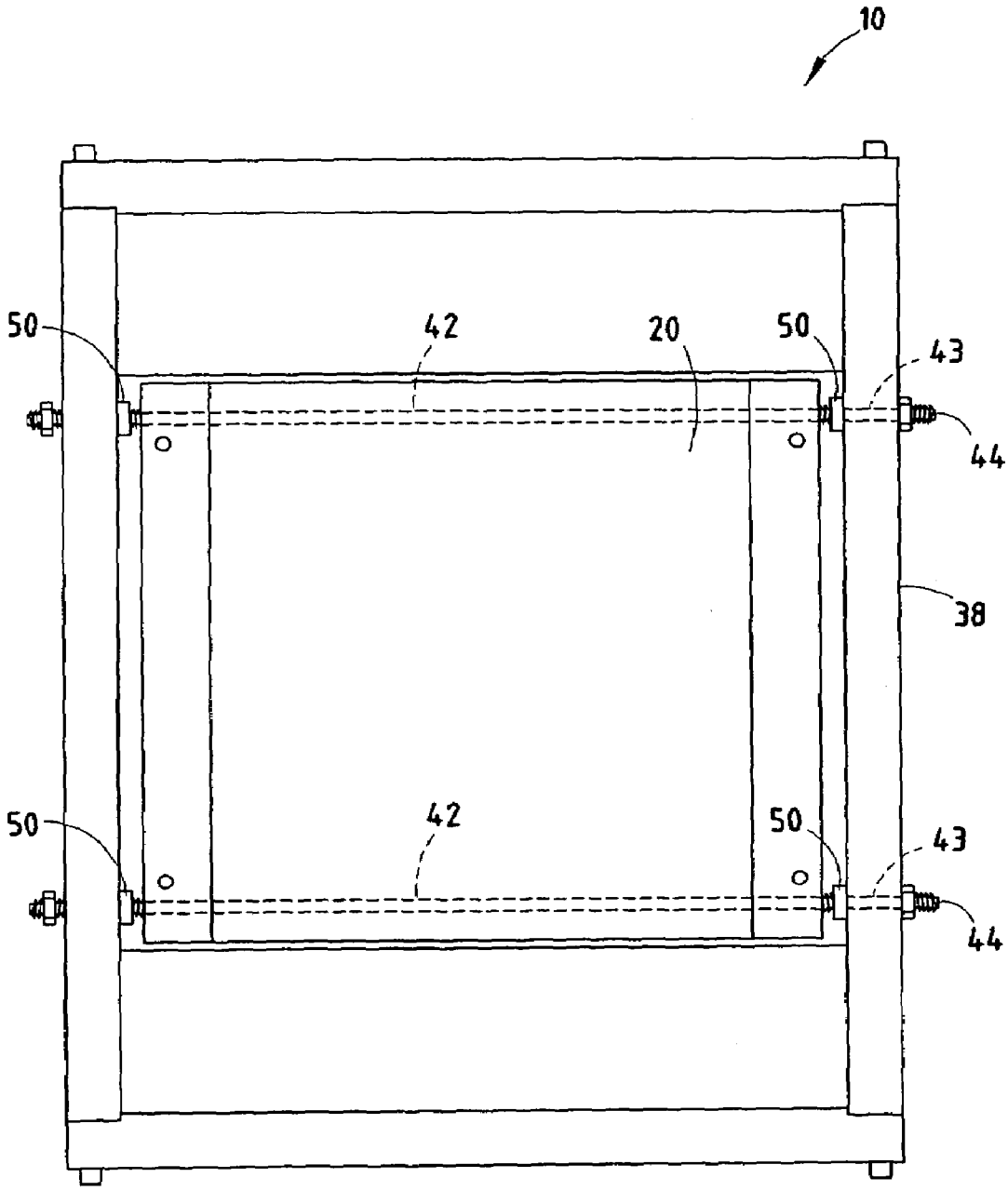
FIG. 11 is a top plan view of the electroplating tool shown in FIG. 1.
Figure 12:
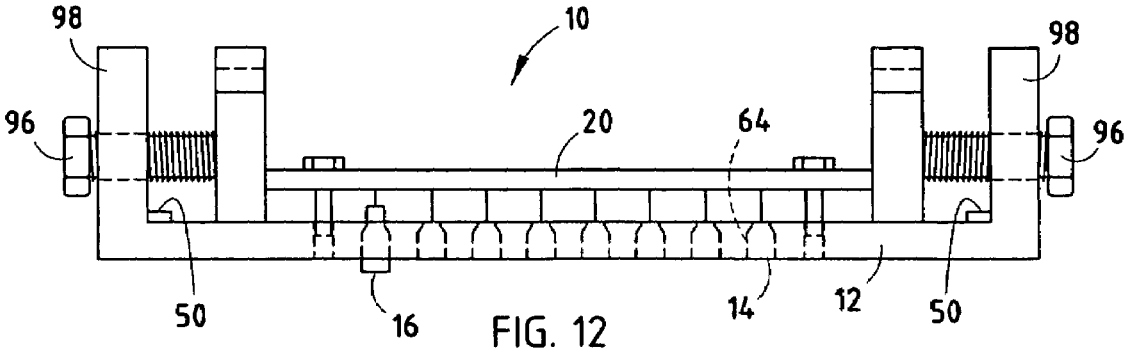
FIG. 12 is an elevational side view of a further alternative embodiment of the electroplating tool of the invention.

In accordance with certain embodiments of the invention (FIGS. 1 and 3), second plate 20 is held in the predetermined spatial relationship with respect to first plate 12 by a frame 38 carrying the mechanism 40 for shifting one of the plates with respect to the other. A suitable mechanism (FIG. 11) for shifting one of the first and second plates with respect to the other of the first and second plates comprises threaded bores 42 extending through one of the first and second plates and bores 43 extending through frame 38, and screws 44 received in the threaded bores, wherein screws 44 extend through frame 38 , such that shifting of second plate 20 with respect to first plate 12 is achieved by rotation of screws 44.

In accordance with certain embodiments of the invention, the mechanism for shifting one of the plates with respect to the other plate allows shifting of the plates from a first disengaged orientation (FIGS. 4 and 7) to either a second (FIGS. 5 and 8) or third (FIGS. 6 and 9) orientation in which the retaining elements are in engagement with the pieces received in the holes. In the embodiments shown in FIGS. 1–9, movement from the first position to the third position is in a direction opposite of movement from the first position to the second position. This arrangement allows the direction of forces applied to the retaining elements to be reversed for alternating electroplating processes. Thus, the retaining elements may be bent in one direction for a first electroplating operation and in the opposite direction for a second electroplating operation, whereby the effects of deformation memory (the inability of a resilient material to return exactly to its original shape) are counteracted and/or minimized so that permanent deformation of the retaining elements is prevented.

Permanent deformation of the retaining elements can also be caused by overshifting one plate with respect to the other plate, which could in turn cause the retaining elements to be bent beyond a threshold limit where resilient recovery fails to occur to a satisfactory extent, resulting in permanent deformation of the retaining elements. In order to prevent overshifting of the first plate with respect to the second plate, and prevent permanent deformation of the retaining elements, the shifting mechanism may include one or more spacers or stops 50 (FIGS. 1, 3, 11 and 12) to limit the distance that the first plate may be shifted with respect to the second plate.

In accordance with certain embodiments of this invention (FIGS. 1 and 3), first plate 12 can include a plurality of electrically conductive posts 52 that can be electrically connected to an electroplating circuit (not shown). At least one electrical conductor 54 can be extended between at least two of the posts 52 to allow electrical current to be drawn away from certain surfaces of certain pieces to achieve more uniform plating of all surfaces of all pieces than would be possible without the posts and electrical conductor. In particular, there is a tendency for surfaces that are in close proximity to the periphery of the tool to be plated more heavily (thicker) than areas nearer the center of the tool, i.e., pieces 16 near the outer edges tend to have thicker plating than those near the center of the tool. A more even distribution of plating thicknesses can be achieved by drawing current (reducing current density) away from exposed surfaces of pieces 16 near the periphery of the tool.

Another technique that may be used for achieving more uniform electroplating thicknesses of all surfaces of all pieces involves application of an electrically insulative material to selected surfaces of the first plate. In particular, it has been discovered that application of electrically insulative material such as vinyl tape 56 (FIG. 3) on selected surfaces near the perimeter of the tool reduces local electrical current densities for exposed surfaces of pieces 16 near the periphery of the tool. The result is that more uniform electroplating thicknesses are achieved for all surfaces of all pieces than would occur without the insulative material.

Figure 13:
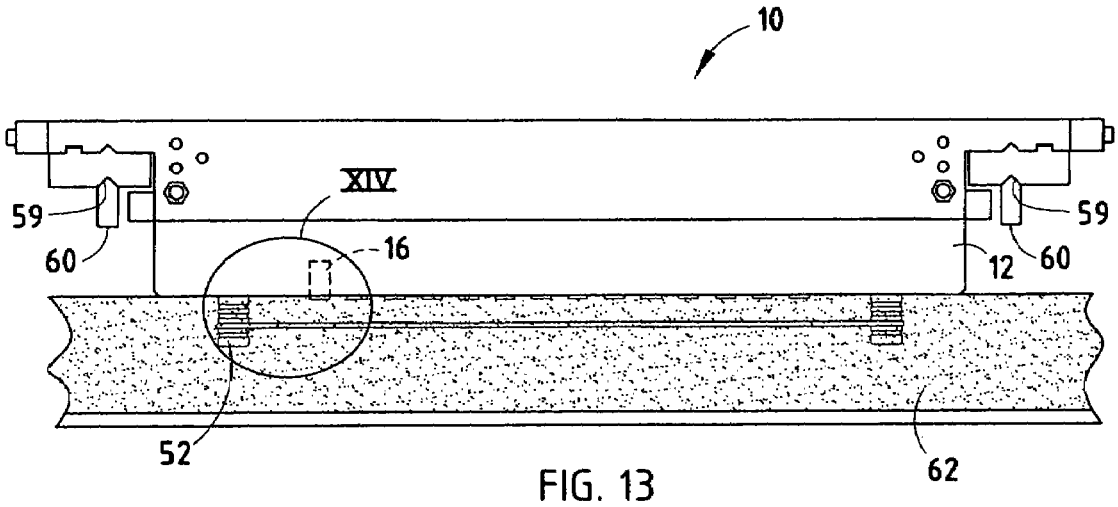
FIG. 13 is an elevational front view of an electroplating tool in accordance with the invention mounted on a support structure that facilitates partial immersion of the tool face in an electroplating solution.
Figure 14:
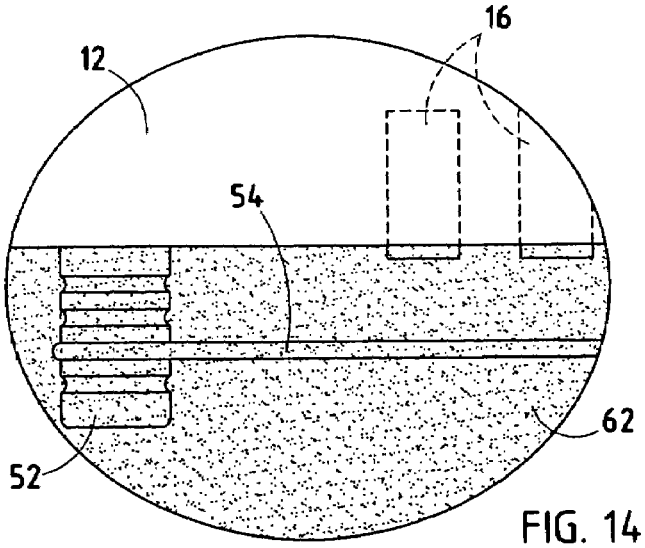
FIG. 14 is an enlarged view of the area surrounded by circled C of FIG. 13.

In accordance with certain embodiments of the invention (FIG. 13), electroplating tool 10 may be provided with notches 59 to allow tool 10 to be supported on rods 60 that facilitate suspension of electroplating tool 10 at the surface of an electroplating solution 62. Suspending most of tool 10 above electroplating solution 62 such that only the surfaces of the pieces that are to be electroplated (as shown in FIG. 14), and optionally a portion of the surface of the first plate in the electroplating solution, while the remainder of the tool is suspended out of contact with the electroplating solution reduces undesirable electroplating onto tool 10 and eliminates and/or reduces the need for plating striping/cleaning operations.

In accordance with certain embodiments of the invention (FIGS. 7–9 and 12), each of the holes 14 includes a tapered section 64 defining a shoulder that serves as a stop for the pieces and establishes the amount of surface of the piece that is exposed for electroplating. In other embodiments (FIGS. 3–6), each of the holes 14 has a uniform diameter throughout the thickness of first plate 12, and the first and second plates are held in abutment so that second plate 20 acts as a stop for the pieces and together with the thickness of first plate 12 establishes the amount of surface of piece 16 that is exposed for electroplating.

Figure 10:
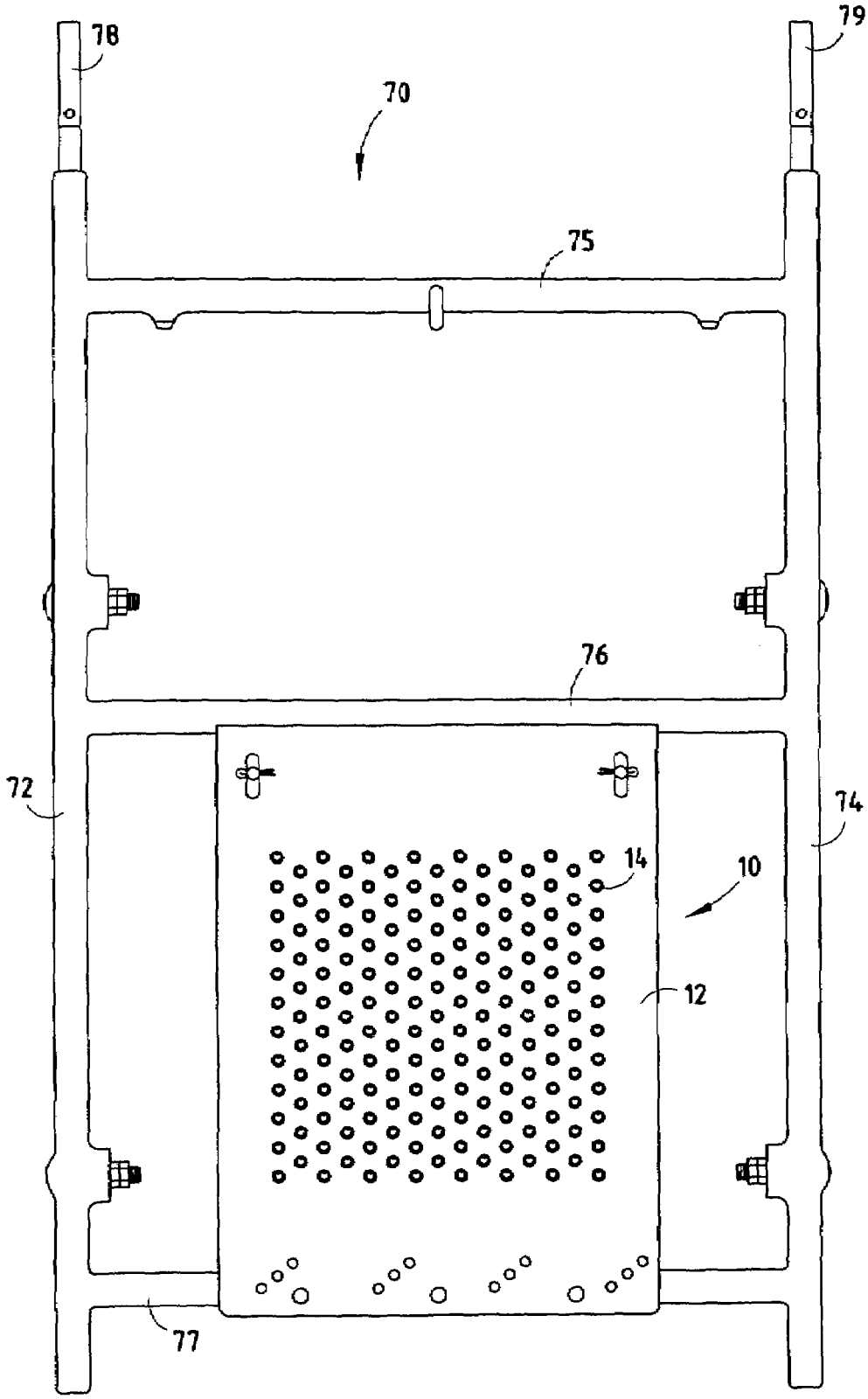
FIG. 10 shows a fragmented top plan view of a tool mounted on a frame for total immersion plating.

Shown in FIG. 10 is a support structure 70 that is designed to hold electroplating tool 10. Electroplating tool 10 is designed to retain and maintain electrical contact with a plurality of pieces that are to be electroplated on selected surfaces of the pieces during an electroplating process. Support structure 70 includes a pair of spaced apart vertical members 72, 74 and spaced apart horizontal cross members 75, 76 and 77 that provide a rigid framework. Projecting upwardly from vertical members 72 and 74 are electrically conducting hooks 78 and 79 for suspending support structure 70 from an electrically conductive horizontal rail (not shown). An electrical current flows through the support rail (not shown), through at least one of hooks 78 and 79, through electrical conductors (not shown) within structure 10, through an electrically conductive path defined in tool 10, and through individual pieces 16 mounted on tool 10. The electroplating circuit is completed by cation transport from an anode, through an electroplating bath, and deposition (i.e., plating) onto the pieces. This embodiment provides for mounting of several tools on a frame for complete immersion in plating solution 62.

First plate 12 and second plate 20 may be made of aluminum, stainless steel or other electrically conductive material that exhibits a suitable resistance to corrosion and chemical attack by the electroplating bath in which it is intended to be used. Alternatively, plate 12 may be made of a plastic material (e.g., nylon, polycarbonate, acrylonitrile-butadiene-styrene, etc.).

Prongs 30 may be mechanically attached to plate 20 such as by positioning prongs 30 in apertures 80 provided through plate 20 and using a swaged interference fit for firmly (i.e., permanently) holding prongs 30 to plate 20. Prongs 30 may instead be welded, soldered or firmly held in place using other techniques. The technique for holding prongs 30 to plate 20 can facilitate electrical connection between plate 20 and prongs 30. A combination of mechanical swaging and back-welding of solder 90 (FIGS. 4–6) may also be employed for fixing prongs 30 to plate 20. Prongs 30 can be comprised of a springy material that allows prongs 30 to be bent slightly when a force is applied so that prongs 30 will resiliently engage the pieces to be electroplated during an electroplating process and return substantially to its original shape at the conclusion of the electroplating process after the force is removed. The expression "resilient engagement" refers to a compressive force that is exerted on prong 30 while it is deformed by engagement with the piece that is to be electroplated. This resilient engagement holds the multitude of pieces to be electroplated on tool 10 during the electroplating process, and can be used to ensure good electrical contact between the prongs and the pieces during electroplating of the pieces.

Pieces 16 can be transferred to plate 12 from a cassette (not shown) that is configured with a multitude of apertures arranged in a pattern identical to the holes 14 of plate 12. However, the apertures in the cassette would not necessarily be identical to holes 14, since plate 12 and the cassette are designed to hold pieces 16 in different orientations. Pieces 16 may be loaded onto plate 12 by placing plate 12 in an inverted position over the cassette with holes 14 in alignment with apertures in the cassette, and inverting plate 12 with the cassette to dump pieces 16 into holes 14 of plate 12. Automated high speed apparatus which are not part of this invention may be utilized for loading pieces 16 on a cassette.

After pieces 16 have been loaded into holes 14, plate 12 is positioned on plate 20 in a first orientation, with prongs 30 centered with an axial bore defined through each of the pieces 16. Known indexing means may be used for achieving this operation. Plate 12 is then moved linearly with respect to plate 20 to a second orientation while maintaining a parallel relationship with plate 20 and while maintaining a predetermined spacing between plate 12 and plate 20, to cause prongs 30 to engage internal walls of the central bore through pieces 16. The springiness or resilience of prongs 30 hold pieces 16 firmly between walls of holes 14 and prongs 30 to allow retention of pieces 16 on tool 10 during an electroplating process and to provide good electrical contact during the electroplating process.

Various mechanisms may be employed for holding plate 12 to plate 20 while facilitating movement of plate 12 with respect to plate 20 from the first orientation in which prongs 30 extend perpendicularly from plate 20 and through the central bore extending through pieces 16 and are out of engagement with parts 16 and a second position in which plate 12 is shifted slightly with respect to plate 20 to cause engagement of prongs 30 with each of the individual pieces 16. In the embodiment shown in FIG. 12, plate 20 may be shifted from the first orientation to the second orientation manually (in which case screws 96 may be eliminated), or screws 96 extending though lateral uprights 98 at opposite ends of plate 12 may be utilized for effecting movement of plate 70 with respect to plate 12. Stops 50 are provided to indicate and limit movement of plate 20 with respect to plate 12 between the first and second orientations. It may be desirable to configure tool 10 so that prongs 30 are bent in different directions for different plating processes, e.g., alternative directions for a series of processes. This reduces spring memory bias effects.

Figure 3:
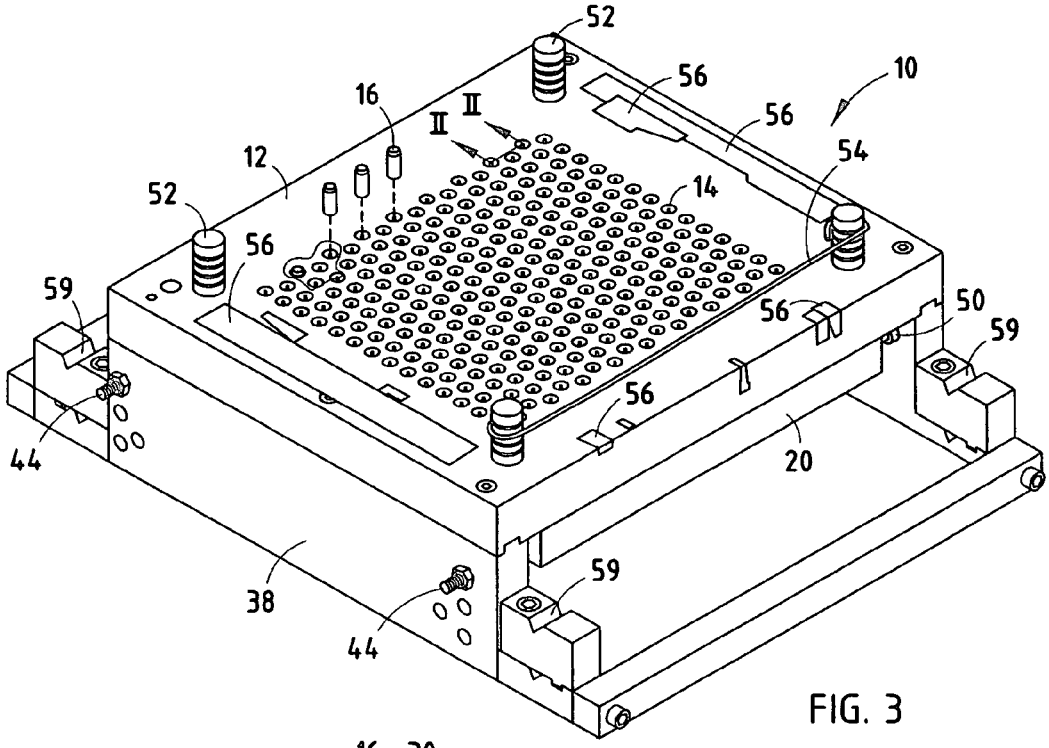
FIG. 3 is a perspective view of an alternative embodiment of an electroplating tool in accordance with the invention.
Figure 4:
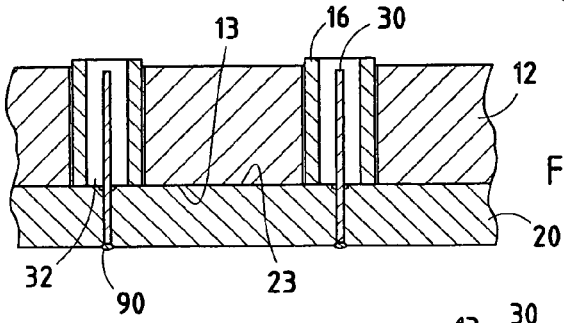
FIGS. 4–6 are fragmented transverse cross-sectional views as seen along lines A—A of FIG. 3 showing tool plates in various alternative orientations.
Figure 5:
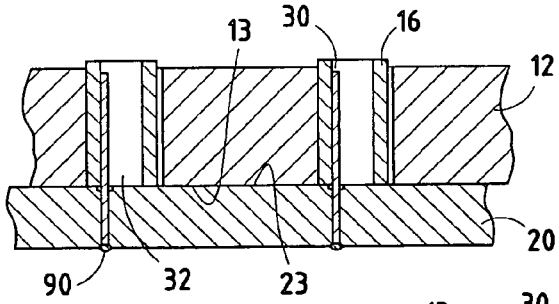
Figure 6:
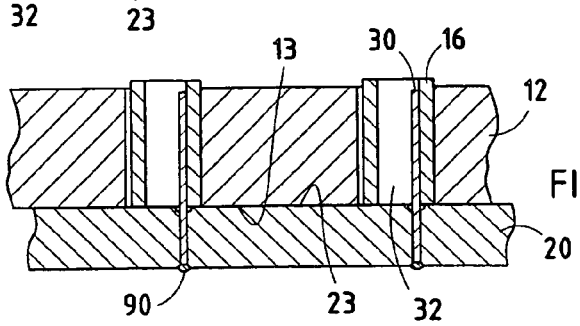
Figure 7:
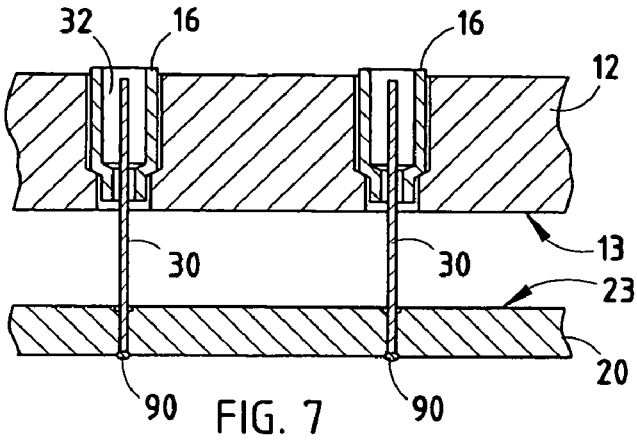
FIGS. 7–9 are fragmented transverse cross-sectional views as seen along lines B—B of FIG. 1 showing tool plates in various alternative orientations.
Figure 8:
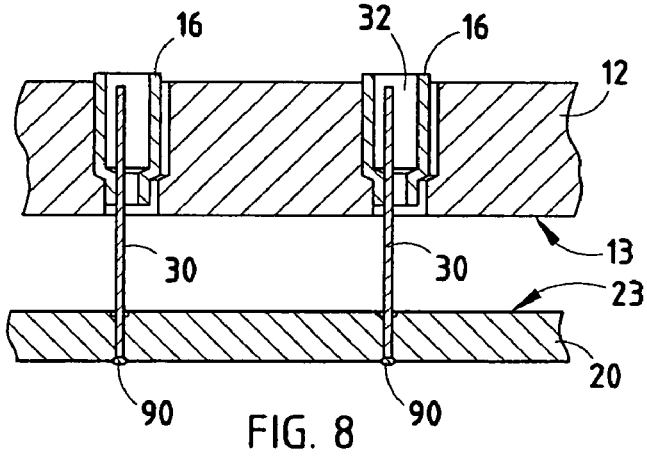
Figure 9:
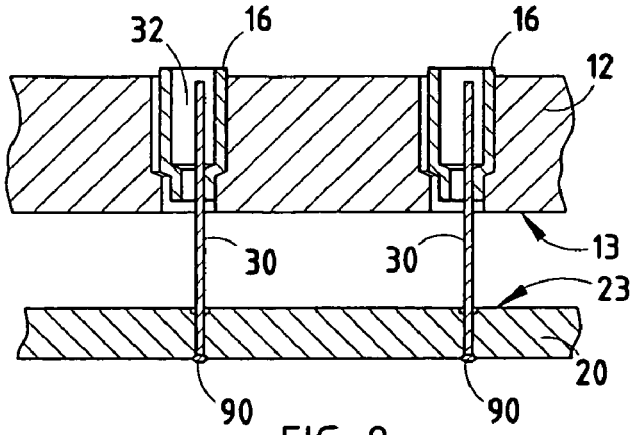

Channels or grooves 99 (FIG. 1) may be provided on plate 20 to allow electroplating solution to easily drain from tool 10, this is more beneficial when plat 02 is used in the arrangement shown in FIG. 3, wherein plates 12 and 20 are in abutment during electroplating of pieces 16.

It should be apparent that either plate 12' or plate 20 may be provided with slots or other means for facilitating movement of plate 12 with respect to plate 20. Similarly, screws or other means may be provided on either plate 12 or plate 20 to effect movement of plate 12, with respect to plate 20. Various other structures such as rails, grooves, etc. may be employed to facilitate movement of plate 12 with respect to plate 20, and various structures other than screws, e.g., levers, linkages and the like, may be employed for effecting movement of plate 12 with respect to plate 20.

The invention facilitates easy handling and reliable electroplating of a multitude of small, difficult to handle parts in a single process using few steps.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An electroplating tool for selectively plating a portion of the surface of each of a plurality of pieces, comprising:

a first plate having a face defining a plurality of holes arranged in a pattern, each of the holes configured to receive a piece that is to be electroplated, each hole further being configured to mask a portion of the surface of a piece received in a hole and expose another portion of the surface of the piece for electroplating;

a second plate having a plurality of retaining elements, the second plate being held in a predetermined spatial relationship with respect to the first plate;

a mechanism for shifting one of the first and second plates with respect to the other of the first and second plates between a first orientation in which the retaining elements are in a position corresponding to disengagement with pieces received in the holes and a second orientation in which the retaining elements are in a position corresponding to engagement with pieces received in the holes; and a means for applying electrical current to cause electroplating on the surface of each piece that is exposed for electroplating.

2. The electroplating tool of claim 1, wherein the retaining elements are prongs that project from a face of the second plate, the prongs arranged on the second plate in a pattern corresponding with the pattern of holes in the first plate, whereby each of the prongs can be inserted through a corresponding hole in the first plate and through an opening in a piece that can be located in the hole.

3. The electroplating tool of claim 1, wherein the second plate is held in the predetermined spatial relationship with respect to the first plate by a frame carrying the mechanism for shifting one of the plates with respect to the other.

4. The electroplating tool of claim 3, wherein the mechanism for shifting one of the first and second plates with respect to the other of the first and second plates comprises threaded bores extending through one of the first and second plates and screws received in the threaded bores, said screws extending through said frame, whereby shifting of said first plate with respect to said second plate is achieved by rotation of said screws.

5. The electroplating tool of claim 1, wherein the mechanism for shifting one of the first and second plates with respect to the other of the first and second plates between said first orientation and said second orientation is configured to further allow shifting between said first orientation and a third orientation in which the retaining elements are in a position corresponding to engagement with pieces received in the holes, movement from the first position to the third position being in a direction opposite of movement from the first position to the second position, whereby the direction of forces applied to the retaining elements may be reversed for alternating electroplating processes so that permanent deformation of the retaining elements can be prevented.

6. The electroplating tool of claim 1, wherein the mechanism for shifting one of the first and second plates with respect to the other of the first and second plates includes at least one stop to limit the distance that the first and second plates can be shifted with respect to one another, whereby permanent deformation of the retaining elements can be prevented.

7. The electroplating tool of claim 1, wherein the first plate includes a plurality of electrically conductive posts that can be electrically connected to an electroplating circuit, whereby at least one electrical conductor can be extended between at least two of the posts to allow electrical current to be drawn away from certain surfaces of certain pieces to achieve more uniform plating of all surfaces of all pieces than would be possible without the posts and electrical conductor connected to the electroplating circuit.

8. The electroplating tool of claim 1, wherein notches are defined in the frame for engaging support rods which allow the tool to be easily suspended in an electroplating solution or at the surface of an electroplating solution, with surfaces of pieces to be electroplated in contact with the electroplating solution, and with at least a portion of the tool being suspended above the electroplating solution to reduce undesirable plating of the tool.

9. The electroplating tool of claim 1, wherein the first plate is electrically conductive and can be electrically connected to an electroplating circuit.

10. The electroplating tool of claim 9, wherein an electrically insulative material is located on selected surfaces of the first plate to reduce electrical current at certain surfaces of certain pieces to achieve more uniform electroplating thicknesses of all surfaces of all pieces than would occur without the insulative material located on the selected surfaces of the first plate.

11. The electroplating tool of claim 1, wherein the first plate is electrically insulative, and the retaining elements are electrically conductive and electrically connected to an electroplating circuit.

12. The electroplating tool of claim 1, wherein each of the holes includes a tapered section defining a shoulder that serves as a stop for the pieces and establishes the amount of surface of the piece that is exposed for electroplating.

13. The electroplating tool of claim 1, wherein each of the holes has a uniform diameter through the thickness of the first plate, and the first and second plates are held in abutment so that the second plate acts as a stop for the pieces and together with the thickness of the first plate establish the amount of surface of the piece that is exposed for electroplating.

14. A process for selectively electroplating a surface of each of a plurality of pieces, comprising:

providing an electroplating tool having a first plate including a face defining a plurality of holes arranged in a pattern, each of the holes configured to receive a piece that is to be electroplated, each hole further being configured to mask a portion of the surface of a piece received in the hole and expose another portion of the surface of the piece for electroplating, a second plate having a plurality of retaining elements, and a frame holding the first plate and the second plate in a predetermined spatial relationship, the frame including a mechanism for shifting one of the first and second plates with respect to the other of the first and second plates between a first orientation in which the retaining elements are in a position corresponding to disengagement with pieces received in the holes and a second orientation in which the retaining elements are in a first position corresponding to engagement with pieces received in the holes;

locating a piece that is to electroplated on a selected portion of its surface in each of the holes;

shifting one of the first and second plates with respect to the other from the first orientation to the second orientation to retain the pieces in the holes;

positioning the plating tool retaining the pieces so that at least the portion of each piece that is to be plated and which is received in one of the holes is immersed in an electroplating solution; and applying an electrical current through the electroplating solution while at least the surface of each piece that is to be electroplated is immersed in the electroplating solution to cause electroplating on the surface of each piece that is exposed for electroplating.

15. The process of claim 14, wherein the first plate includes a plurality of electrically conductive posts that can be electrically connected to an electroplating circuit, whereby at least one electrical conductor can be extended between at least two of the posts to allow electrical current to be drawn away from certain surfaces of certain pieces to achieve more uniform plating of all surfaces of all pieces than would be possible without the posts and electrical conductor connected to the electroplating circuit.

16. The process of claim 14, wherein the first plate is electrically conductive and is electrically connected to an electroplating circuit, and wherein an electrically insulative material is located on selected surfaces of the first plate to reduce electrical current at certain surfaces of certain pieces to achieve more uniform electroplating thicknesses of all surfaces of all pieces than would occur without the insulative material located on the selected surfaces of the first plate.

17. The process of claim 14, in which the entire tool holding the pieces for electroplating is immersed in the electroplating solution during application of the electrical current.

18. The process of claim 14, in which the tool is suspended so that surfaces of the pieces that are to be electroplated are immersed in the electroplating solution and at least a portion of the tool is above the electroplating solution during the electroplating process to reduce undesirable plating of the tool.

19. The process of claim 14, wherein the retaining elements are prongs that project from a face of the second plate, the prongs arranged on the second plate in a pattern corresponding with the pattern of holes in the first plate, whereby each of the prongs is inserted through a corresponding hole in the first plate and through an opening in a piece that can be located in the hole.

20. The process of claim 14, in which the tool is mounted on a frame and totally immersed in the electroplating solution for electroplating the pieces.

* * * * *